US009181921B2

(12) United States Patent
Kanehara et al.

(10) Patent No.: US 9,181,921 B2
(45) Date of Patent: Nov. 10, 2015

(54) LASER IGNITION APPARATUS

(71) Applicants: NIPPON SOKEN, INC., Nishio, Aichi-pref. (JP); DENSO CORPORATION, Kariya, Aichi-pref. (JP)

(72) Inventors: Kenji Kanehara, Toyohashi (JP); Shingo Morishima, Toyota (JP); Akimitsu Sugiura, Nagoya (JP)

(73) Assignees: DENSO CORPORATION, Kariya (JP); NIPPON SOKEN, INC., Nishio (JP)

( * ) Notice: Subject to any disclaimer, the term of this patent is extended or adjusted under 35 U.S.C. 154(b) by 217 days.

(21) Appl. No.: 13/760,351

(22) Filed: Feb. 6, 2013

(65) Prior Publication Data

US 2013/0206091 A1 Aug. 15, 2013

(30) Foreign Application Priority Data

Feb. 13, 2012 (JP) ..... 2012-028260

(51) Int. Cl.
*F02P 23/04* (2006.01)
*H01T 13/50* (2006.01)

(52) U.S. Cl.
CPC *F02P 23/04* (2013.01); *H01T 13/50* (2013.01)

(58) Field of Classification Search
CPC ..... F02P 23/04; F02P 9/007; F02P 23/045; H01T 13/50; F02B 1/04
USPC ..... 123/143 B, 143 A
See application file for complete search history.

(56) References Cited

U.S. PATENT DOCUMENTS

| | | | | |
|---|---|---|---|---|
| 6,514,069 | B1 * | 2/2003 | Early et al. | 431/1 |
| 7,231,897 | B2 * | 6/2007 | Herdin et al. | 123/143 B |
| 2006/0037572 | A1 * | 2/2006 | Yalin et al. | 123/143 B |
| 2007/0064746 | A1 | 3/2007 | Winklhofer et al. | |

(Continued)

FOREIGN PATENT DOCUMENTS

| | | |
|---|---|---|
| JP | 59-101585 | 6/1984 |
| JP | 2007-506031 | 3/2007 |

(Continued)

OTHER PUBLICATIONS

Geringer, Bernhard, et al. "Laser ignition." MTZ worldwide 65.3 (2004): 24-26.*

(Continued)

*Primary Examiner* — Stephen K Cronin
*Assistant Examiner* — Joshua A Campbell
(74) *Attorney, Agent, or Firm* — Nixon & Vanderhye P.C.

(57) ABSTRACT

In a laser ignition apparatus, a focusing optical element is configured to focus a pulsed laser light to a predetermined focal point in a combustion chamber of an engine. An optical window member is arranged on the combustion chamber side of the focusing optical element so as to separate the focusing optical element from the combustion chamber. A catoptric-light focal point, at which a catoptric light is to be focused, is positioned on the anti-combustion chamber side of a combustion chamber-side end surface of the optical window member. The catoptric light results from the reflection of the pulsed laser light by a pseudo mirror that is formed by the optical window member when the combustion chamber-side end surface thereof is fouled with contaminants. Further, the catoptric-light focal point falls in a region where no solid material forming either the focusing optical element or the optical window member exists.

9 Claims, 9 Drawing Sheets

(56) References Cited

U.S. PATENT DOCUMENTS

| | | | | |
|---|---|---|---|---|
| 2009/0133655 | A1* | 5/2009 | Inohara et al. | 123/143 B |
| 2009/0158952 | A1* | 6/2009 | Gruber | 102/201 |
| 2009/0159031 | A1* | 6/2009 | Gruber | 123/143 B |
| 2010/0275867 | A1* | 11/2010 | Weinrotter et al. | 123/143 B |
| 2010/0275868 | A1 | 11/2010 | Herden et al. | |

FOREIGN PATENT DOCUMENTS

| | | |
|---|---|---|
| JP | 2010-116841 | 5/2010 |
| JP | 2011-501402 | 1/2011 |
| JP | 2011-256722 | 12/2011 |

OTHER PUBLICATIONS

G. Herdin et al., "Laser Ignition—a New Concept to Use and Increase the Potentials of Gas Engines", ICEF2005-1352; *ASME Internal Combustion Engine Division 2005 Fall Technical Conference: ARES-ARICE Symposium on Gas Fired Reciprocating Engines*, Sep. 2005, pp. 1-9.

Japanese Office Action issued in Application No. 2012-028260 dated Jul. 7, 2015 (w/ translation).

* cited by examiner

FOCUSING OPTICAL SYSTEM a

FOCUSING OPTICAL SYSTEM b

FOCUSING OPTICAL SYSTEM c $L_{FP}-T_{CG}-G_1=L_1$
$T_{FL}+G_1+T_{CG}<L_1$
$0<G_1<\{L_{FP}-(T_{FL}+2T_{CG})\}/2$ $T_{FL}+G_2+T_{CG}\geqq L_2=L_{FP}-(G_2+T_{CG})$
$\{L_{FP}-(T_{FL}+2T_{CG})\}/2\leqq G_2$
$FI\geqq 40.5GW/cm^2$ $G_3+T_{CG}\leqq L_3=L_{FP}-(G_3+T_{CG})$
$G_3\leqq(L_{FP}-2T_{CG})/2$
$FI\geqq 40.5GW/cm^2$ $T_{CG}<L_4=L_{FP}-(G_4+T_{CG})$
$G_4<(L_{FP}-2T_{CG})$
$(L_{FP}-2T_{CG})/2<G_4$ $T_{CG}\geqq L_5=L_{FP}-(G_5+T_{CG})$
$G_5\geqq(L_{FP}-2T_{CG})$
$FI\geqq 40.5GW/cm^2$

TABLE 2

| LASER INPUT CONDITION | A | B | | |
|---|---|---|---|---|
| | 5.2mJ 1.6ns | 11.5mJ 0.87ns | | |
| FOCUSING OPTICAL SYSTEM | a(φ3.48mm) | a(φ3.48mm) | b(φ2.94mm) | c(φ2.49mm) |
| FIRST TEST CONDITION |  |  |  |  |
| | — | φ0.94mm | φ1.34mm | φ1.39mm |
| SECOND TEST CONDITION |  |  |  |  |
| | — | φ0.99mm | φ1.36mm | φ1.29mm |

LASER IGNITION APPARATUS

CROSS-REFERENCE TO RELATED APPLICATION

This application is based on and claims priority from Japanese Patent Application No. 2012-28260, filed on Feb. 13, 2012, the content of which is hereby incorporated by reference in its entirety into this application.

BACKGROUND

1. Technical Field

The present invention relates generally to laser ignition apparatuses for ignition of internal combustion engines. More particularly, the invention relates to a laser ignition apparatus for ignition of an internal combustion that is difficult to be ignited, such as a highly-charged engine, a high-compression engine or a natural gas engine that has large bore cylinders.

2. Description of Related Art

In recent years, various laser ignition apparatuses have been proposed for ignition of internal combustion engines that are difficult to be ignited; those engines include, for example, highly-charged engines, high-compression engines, and natural gas engines with large bore cylinders. The laser ignition 20 apparatuses are generally configured to: (1) irradiate an excitation light generated by an excitation light source (e.g., a flash lamp or a semiconductor laser) to a laser resonator (or optical resonator) that includes a laser medium and a Q switch, thereby causing the resonator to generate a pulsed laser light that has a short pulse width and a high power density; and (2) focusing the pulsed laser 25 light, using an optical element (e.g., a focusing lens), to a focal point (or an ignition point) in a combustion chamber of the engine to generate a flame kernel that has a high power density, thereby igniting the air-fuel mixture in the combustion chamber.

For example, a first prior art document (i.e., "Laser Ignition-a New Concept to Use and Increase the Potentials of Gas Engines" presented by Dr. Günther Herdin et al., ICEF2005-1352 (page 1-9), ASME Internal Combustion Engine Division 2005 Fall Technical Conference: ARES-ARICE Symposium on Gas Fired Reciprocating Engines, Sep. 11-14, 2005, Ottawa, Canada) discloses a laser ignition apparatus for ignition of a gas engine. The laser ignition apparatus includes a combustion chamber window. Further, when the power density of a laser light generated by the laser ignition apparatus is higher than or equal to a predetermined threshold, the apparatus can exert an effect of burning off contaminants (e.g., unburned fuel or soot) that has deposited on a combustion chamber-side end surface of the combustion chamber window; the predetermined threshold is close to the strength limit of the combustion chamber window.

A second prior art document (i.e., Japanese Unexamined Patent Application Publication No. 2010-116841) discloses a laser ignition apparatus which includes: a protective cover for protecting a focusing lens of the apparatus; means for detecting contaminants having adhered to a combustion chamber-side end surface of the protective cover; and means for burning off the contaminants with a laser light that has a predetermined power density.

However, in either of the laser ignition apparatuses disclosed in the first and second prior art documents, when the laser light with the predetermined power density is irradiated for burning off the contaminants having deposited on or adhered to the combustion chamber-side end surface of the protective cover (or the combustion chamber window), a pseudo mirror may be formed by the protective cover that is fouled with the contaminants. Consequently, part or the whole of the irradiated laser light may be reflected by the pseudo mirror, forming a catoptric-light focal point on the anti-combustion chamber side (i.e., the opposite side to the combustion chamber) of the protective cover; at the catoptric-light focal point, a catoptric light resulting from the reflection of the laser light by the pseudo mirror is focused.

Further, when the catoptric-light focal point is positioned within the focusing lens or the protective cover, concentration of the energy of the catoptric light may occur in the focusing lens or the protective cover, generating a plasma or a shock wave therein. Consequently, damage may be made to the focusing lens or the protective cover, such as causing cracks to occur in the focusing lens or the protective cover or causing an AR (Anti-Reflective) coating formed on the surface of the focusing lens to be peeled off.

Furthermore, due to the damage made to the focusing lens or the protective cover, scattering of the laser light may occur when it passes through the damaged part of the focusing lens or the protective cover, thereby lowering the power density of the laser light at the focal point in the combustion chamber. Consequently, it may become difficult for the laser ignition apparatus to reliably ignite the air-fuel mixture in the combustion chamber.

SUMMARY

According to an exemplary embodiment, a laser ignition apparatus is provided which includes an excitation light source, a regulating optical element, a laser resonator, an enlarging optical element, a focusing optical element and an optical window member. The excitation light source is configured to output an excitation light. The regulating optical element is configured to regulate the excitation light outputted from the excitation light source and introduce the regulated excitation light into the laser resonator. The laser resonator is configured to generate, upon introduction of the regulated excitation light from the regulating optical element thereinto, a pulsed laser light and output the generated pulsed laser light. The enlarging optical element is configured to enlarge the beam diameter of the pulsed laser light outputted from the laser resonator and output the beam diameter-enlarged pulsed laser light. The focusing optical element is configured to focus the beam diameter-enlarged pulsed laser light outputted from the enlarging optical element to a predetermined focal point in a combustion chamber of an engine, thereby igniting an air-fuel mixture in the combustion chamber. The optical window member is arranged on a combustion chamber side of the focusing optical element so as to separate the focusing optical element from the combustion chamber. The optical window member has a combustion chamber-side end surface that faces the combustion chamber and is thus directly exposed to the air-fuel mixture in the combustion chamber. Further, a catoptric-light focal point, at which a catoptric light is to be focused, is positioned on an anti-combustion chamber side of the combustion chamber-side end surface of the optical window member. The catoptric light results from the reflection of the pulsed laser light outputted from the focusing optical element by a pseudo mirror that is formed by the optical window member when the combustion chamber-side end surface of the optical window member is fouled with contaminants existing in the combustion chamber. Furthermore, the catoptric-light focal point falls in a region where no solid material forming either the focusing optical element or the optical window member exists.

With the above configuration, there exists only air around the catoptric-light focal point because the catoptric-light focal point is positioned in a region where no solid material exists as well as because the catoptric-light focal point is separated from the combustion chamber by, at least, the optical window member. The density of air is far lower than that of a solid material. Consequently, even when the catoptric light is focused at the catoptric-light focal point, no plasma will be generated by the catoptric light and thus no damage will be made to the focusing optical element and the optical window member. As a result, it is possible to maintain stable ignition of the air-fuel mixture in the combustion chamber of the engine by the laser ignition apparatus.

It is preferable that in the laser ignition apparatus, the following relationships are satisfied: $L_{FP}=L_{SF}+T_{CG}+G$; and $L_{FP}+T_{FL}<2L_{SF}$, where $L_{FP}$ is the distance from a combustion chamber-side end surface of the focusing optical element to the focal point, $L_{SF}$ is the distance from the combustion chamber-side end surface of the optical window member to the focal point, $T_{CG}$ is the thickness of the optical window member, G is the distance between the combustion chamber-side end surface of the focusing optical element and an anti-combustion chamber-side end surface of the optical window member, and $T_{FL}$ is the thickness of the focusing optical element.

Satisfying the above relationships, the catoptric-light focal point is positioned on the anti-combustion chamber side of the focusing optical element, and thus definitely positioned in a region where no solid material forming either the focusing optical element or the optical window member exists.

Alternatively, it is also preferable that in the laser ignition apparatus, the following inequality is satisfied: $(L_{FP}-2T_{CG})/2<G<(L_{FP}-2T_{CG})$.

Satisfying the above inequality, the catoptric-light focal point is positioned between the focusing optical element and the optical window member, and thus definitely positioned in a region where no solid material forming either the focusing optical element or the optical window member exists.

Preferably, the laser ignition apparatus is configured so that the power density of the pulsed laser light at the combustion chamber-side end surface of the optical window member is higher than or equal to a burn-off threshold power density. Here, the burn-off threshold power density is defined such that the contaminants having deposited on or adhered to the combustion chamber-side end surface of the optical window member can be burned off if the power density of the pulsed laser light at the combustion chamber-side end surface is higher than or equal to the burn-off threshold power density.

With the above configuration, when the combustion chamber-side end surface of the optical window member is fouled with the contaminants having deposited on or adhered to the distal-side end surface, it is possible to burn off the contaminants by the pulsed laser light. Consequently, it is possible to keep the combustion chamber-side end surface of the optical window member clean, thereby preventing a pseudo mirror from being formed by the optical window member due to the contaminants. Moreover, with the combustion chamber-side end surface of the optical window member kept clean, it is possible to secure a high power density of the pulsed laser light at the focal point, thereby reliably igniting the air-fuel mixture in the combustion chamber.

The burn-off threshold power density may be equal to 400 $MW/cm^2$.

Preferably, the laser ignition apparatus is configured so that the power density of the pulsed laser light or the catoptric light when the pulsed laser light or the catoptric light passes through the focusing optical element is lower than or equal to a damage threshold power density of the focusing optical element. Here, the damage threshold power density is defined such that the focusing optical element can be damaged if the power density of the pulsed laser light or the catoptric light is higher than it when the pulsed laser light or the catoptric light passes through the focusing optical element.

With the above configuration, it is possible to prevent the focusing optical element from being damaged by the pulsed laser light or the catoptric light passing through the focusing optical element. Consequently, it is possible to ensure high reliability of the laser ignition apparatus.

The focusing optical element may be made of a quartz glass or a sapphire glass, and the damage threshold power density of the focusing optical element may be equal to 40.5 $GW/cm^2$.

Preferably, the laser ignition apparatus is configured so that the power density of the pulsed laser light or the catoptric light when the pulsed laser light or the catoptric light passes through the optical window member is lower than or equal to a damage threshold power density of the optical window member. Here, the damage threshold power density is defined such that the optical window member can be damaged if the power density of the pulsed laser light or the catoptric light is higher than it when the pulsed laser light or the catoptric light passes through the optical window member.

With the above configuration, it is possible to prevent the optical window member from being damaged by the pulsed laser light or the catoptric light passing through the optical window member. Consequently, it is possible to ensure high reliability of the laser ignition apparatus.

The optical window member may be made of a quartz glass or a sapphire glass, and the damage threshold power density of the optical window member may be equal to 40.5 $GW/cm^2$.

BRIEF DESCRIPTION OF THE DRAWINGS

The present invention will be understood more fully from the detailed description given hereinafter and from the accompanying drawings of one exemplary embodiment, which, however, should not be taken to limit the invention to the specific embodiment but are for the purpose of explanation and understanding only.

In the accompanying drawings.

DESCRIPTION OF EMBODIMENT

Figure 1:
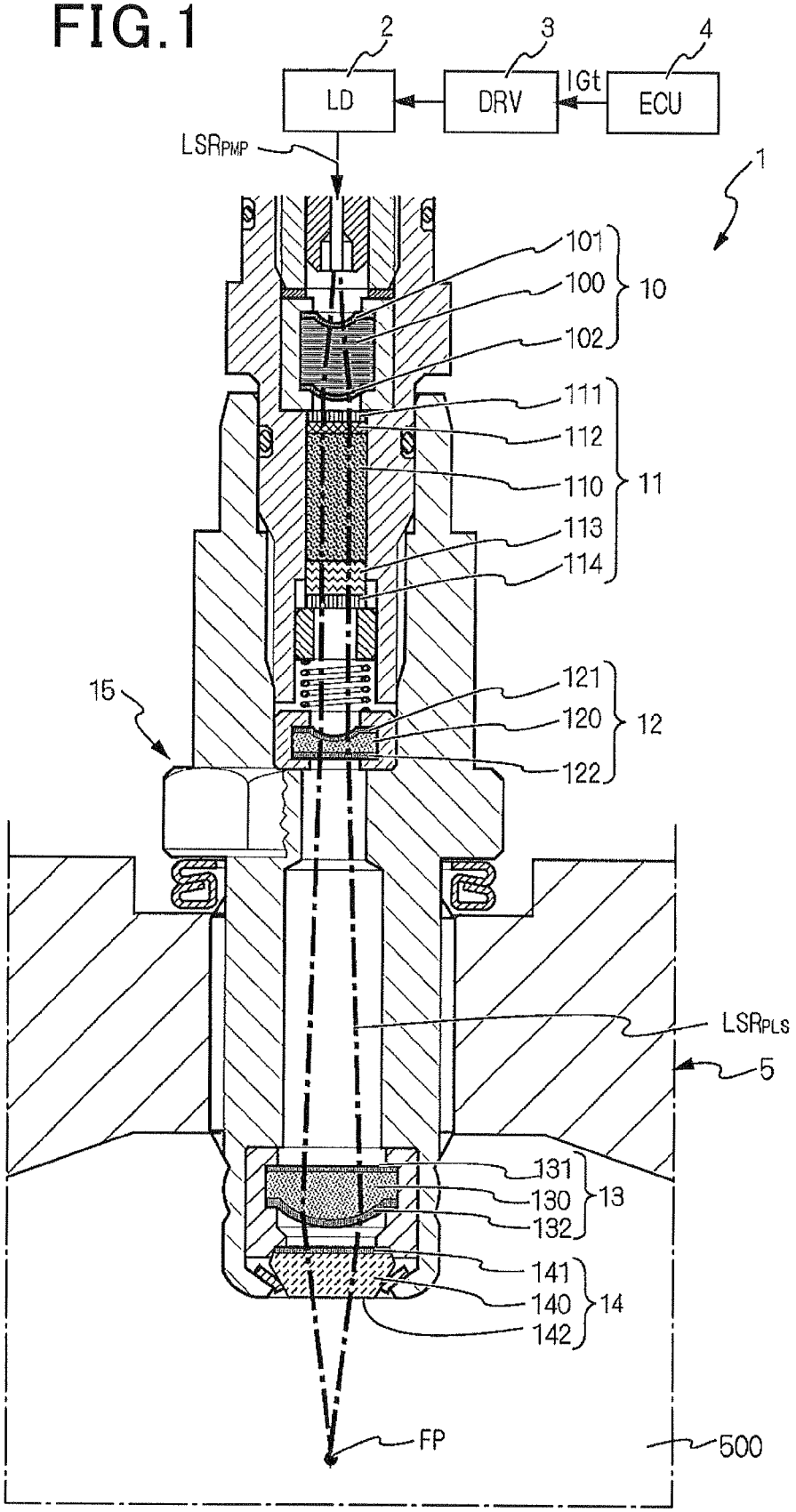
FIG. 1 is a schematic cross-sectional view illustrating the overall configuration of a laser ignition apparatus according to an exemplary embodiment.

FIG. 1 shows the overall configuration of a laser ignition apparatus 1 according to an embodiment.

The laser ignition apparatus 1 is designed to ignite the air-fuel mixture in a combustion chamber 500 of an internal combustion engine 5. More particularly, the laser ignition apparatus 1 is designed to have a high capability of igniting the air-fuel mixture even when the engine 5 is a highly-charged engine, a high-compression engine or a natural gas engine that has a large bore diameter of cylinders.

As shown in FIG. 1, the laser ignition apparatus 1 is configured with an Engine Control Unit (ECU) 4, a drive unit (abbreviated to DRV in FIG. 1) 3, an excitation light source (abbreviated to LD in FIG. 1) 2, a regulating optical element 10, a laser resonator (or optical resonator) 11, an enlarging optical element 12, a focusing optical element 13, an optical window member 14 and a housing 15.

The ECU 4 is configured to output an ignition signal IGt to the drive unit 3 according to the operating condition of the engine 5.

The drive unit 3 is configured to drive the excitation light source 2 according to the ignition signal IGt received from the ECU4. More specifically, the drive unit 3 is configured to start and stop supply of a drive voltage to the excitation light source 2 according to the ignition signal IGt.

The excitation light source 2 is implemented by, for example, a semiconductor laser. Upon receipt of the drive voltage from the drive unit 3, the excitation light source 2 outputs a high-frequency excitation light $LSR_{PMP}$. In addition, in the present embodiment, the excitation light source 2 is located, together with the drive unit 3 and the ECU 4, outside the housing 15.

The excitation light $LSR_{PMP}$ outputted from the excitation light source 2 is transmitted to the regulating optical element 10 via an optical fiber (not shown). The optical fiber may be of a well-known type which has a core diameter of 600 μm and the NA (Numerical Aperture) of which is less than 0.09.

The regulating optical element 10 is configured to regulate the excitation light $LSR_{PMP}$ into a parallel beam having a predetermined beam diameter and introduce the regulated excitation light $LSR_{PMP}$ into the laser resonator 11.

More specifically, the regulating optical element 10 includes a main body 100 that is made of a well-known optical element material, such as an optical glass, a heat-resistant glass, a quartz glass or a sapphire glass. The main body 100 has a light entrance surface 101 that is concave toward the distal side and a light exit surface 102 that is convex toward the distal side. Hereinafter, the distal side denotes the combustion chamber 500 side while the proximal side denotes the anti-combustion chamber side (or the opposite side to the combustion chamber 500). The main body 100 makes up an aspherical lens with the light entrance surface 101 and the light exit surface 102 having different radii of curvature. In addition, on each of the light entrance and light exit surfaces 101 and 102 of the main body 100, there is formed an AR (Anti-Reflective) coating for suppressing reflection of the excitation light $LSR_{PMP}$. The AR coating is made of a well-known AR material, such as magnesium fluoride.

The laser resonator 11 is configured to generate, upon introduction of the regulated excitation light $LSR_{PMP}$ thereinto, a pulsed laser light $LSR_{PLS}$ that has a short pulse width and a high power density. In other words, the laser resonator 11 produces the pulsed laser light $LSR_{PLS}$ by resonating and amplifying the excitation light $LSR_{PMP}$ introduced thereinto.

More specifically, the laser resonator 11 includes a laser medium 110, a totally reflecting mirror 111, an AR coating 112, a passive Q-switch 113 and a partially reflecting mirror 114. The laser medium 110 is made of Nd:YAG (i.e., neodymium-doped yttrium aluminum garnet). When the excitation light $LSR_{PMP}$ is introduced into the laser resonator 11, the laser medium 110 is excited by the excitation light $LSR_{PMP}$ to produce the pulsed laser light $LSR_{PLS}$. The totally reflecting mirror 111 is arranged at the proximal-side end of the laser resonator 11. The totally reflecting mirror 111 totally reflects the pulsed laser light $LSR_{PLS}$ produced by the laser medium 110 while allowing entrance of the excitation light $LSR_{PMP}$ into the laser resonator 11 through the mirror 111. The AR coating 112 is provided for suppressing reflection of the excitation light $LSR_{PMP}$. The passive Q-switch 113 is made of Cr:YAG (i.e., $Cr^{+4}$-doped yttrium aluminum garnet). The partially reflecting mirror 114 is arranged at the distal-side end of the laser resonator 11.

In operation, the pulsed laser light $LSR_{PLS}$ produced by the laser medium 110 bounces back and forth between the totally reflecting mirror 111 and the partially reflecting mirror 114, passing through the laser medium 110 and being amplified each time. When the pulsed laser light $LSR_{PLS}$ has been amplified so that the intensity thereof exceeds a unique threshold of the passive Q-switch 113, the passive Q-switch 113 releases the pulsed laser light $LSR_{PLS}$. Consequently, the pulsed laser light $LSR_{PLS}$ is outputted from the laser resonator 11 via the light exit surface (i.e., the distal-side end surface) of the partially reflecting mirror 114. The pulsed laser light $LSR_{PLS}$ outputted from the laser resonator 11 is in the form of a parallel beam which has a high focusability (e.g., $M^2$=1.2-1.4) and a beam diameter of, for example, about 1.2 mm.

In addition, the laser medium 110 may also be made of other optical materials than Nd:YAG, such as Nd:YVO, Nd:GVO, Nd:GGG, Nd:SUAP, Yb:YAG and Yb:LUAG. Similarly, the passive Q-switch 113 may also be made of other optical materials than Cr:YAG, such as Cr:GGG, V:YAG and Co:Spinel.

The enlarging optical element 12 is configured to enlarge the beam diameter of the pulsed laser light $LSR_{PLS}$ outputted from the laser resonator 11 and output the beam diameter-enlarged pulsed laser light $LSR_{PLS}$ to the focusing optical element 13.

More specifically, the enlarging optical element 12 includes a main body 120 that is made of a well-known optical element material, such as an optical glass, a heat-resistant glass, a quartz glass or a sapphire glass. The main body 120 has a light entrance surface 121 and a light exit surface 122, both of which are AR-coated for suppressing reflection of the pulsed laser light $LSR_{PLS}$. The main body 120 makes up an aspherical lens with the light entrance surface 121 and the light exit surface 122 having different radii of curvature.

The focusing optical element 13 is configured to focus the beam diameter-enlarged pulsed laser light $LSR_{PLS}$ to a predetermined focal point FP in the combustion chamber 500, thereby forming a high-energy-state plasma flame kernel to ignite the air-fuel mixture in the combustion chamber 500.

More specifically, the focusing optical element 13 includes a main body 130 that is made of a well-known optical element material, such as an optical glass, a heat-resistant glass, a quartz glass or a sapphire glass. The main body 130 has a light entrance surface 131 and a light exit surface 132, both of which are AR-coated for suppressing reflection of the pulsed laser light $LSR_{PLS}$. The main body 130 makes up an aspherical lens with the light entrance surface 131 and the light exit surface 132 having different radii of curvature.

The optical window member 14 is arranged on the distal side of the focusing optical element 13 so as to separate the focusing optical element 13 from the combustion chamber 500 and thereby protect the focusing optical element 13 from the heat, pressure and fuel in the combustion chamber 500 as well as from contamination by, for example, soot existing in the combustion chamber 500.

The optical window member 14 is made of a well-known optical element material, such as an optical glass, a heat-resistant glass, a quartz glass or a sapphire glass.

The optical window member 14 has a proximal-side end surface (i.e., a light entrance surface) 141 and a distal-side end surface (i.e., a light exit surface) 142. The proximal-side end surface 141 is AR-coated for suppressing reflection of the pulsed laser light $LSR_{PLS}$ outputted from the focusing optical element 13. The distal-side end surface 142 faces the combustion chamber 500 and is thus directly exposed to the air-fuel mixture in the combustion chamber 500.

Figure 2A:
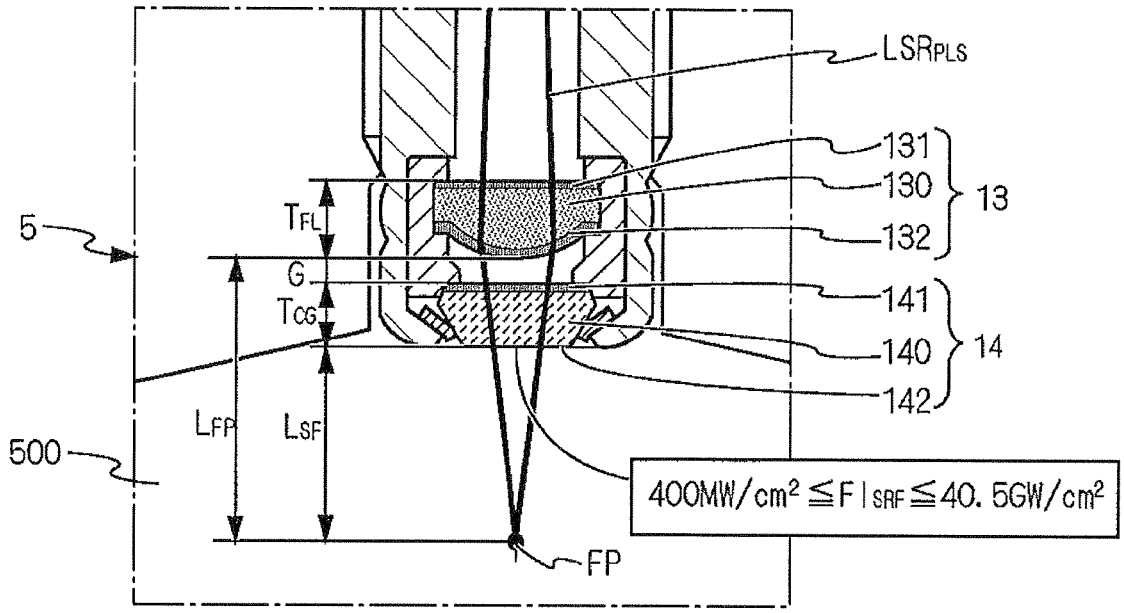
FIG. 2A is a schematic cross-sectional view illustrating part of the laser ignition apparatus in a normal operating state where the apparatus outputs a pulsed laser light with no pseudo mirror formed by an optical window member of the apparatus.
Figure 2B:
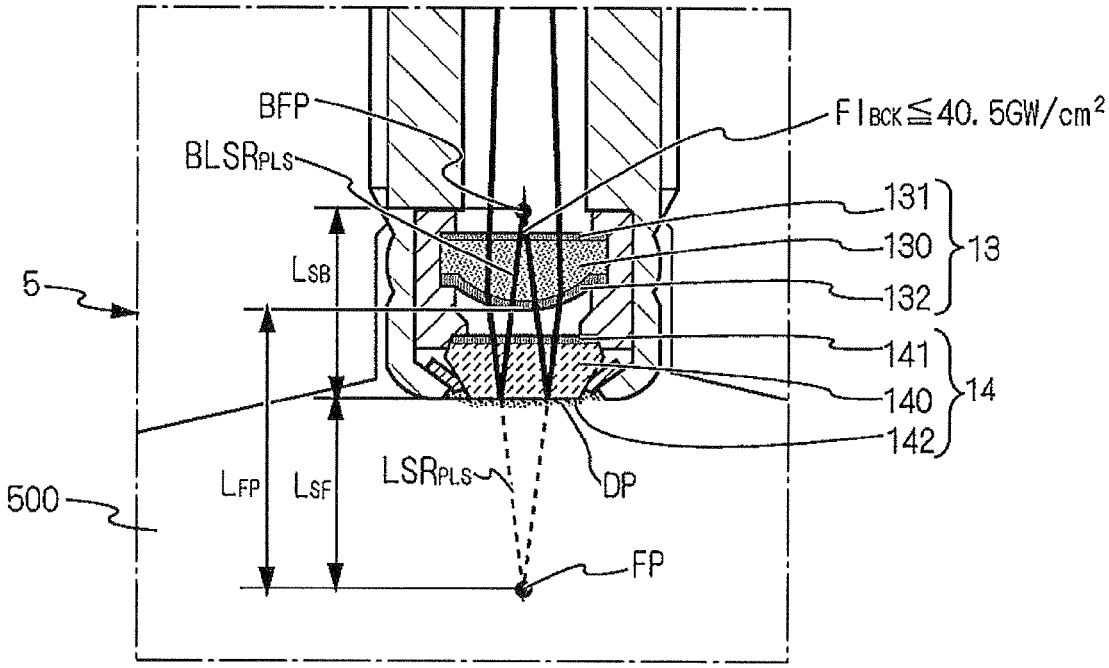
FIG. 2B is a schematic cross-sectional view illustrating part of the laser ignition apparatus in an abnormal operating state where the apparatus outputs the pulsed laser light with a pseudo mirror formed by the optical window member.

Further, defining the distal-side end surface 142 of the optical window member 14 as a reference surface 142, a catoptric-light focal point BFP is positioned on the proximal side of the reference surface 142 so that the focal point FP and the catoptric-light focal point BFP are approximately symmetrical with respect to the reference surface 142 (see FIG. 2B). Here, the catoptric-light focal point BFP denotes a focal point at which a catoptric light (or reflected light) $BLSR_{PLS}$ resulting from the reflection of the pulsed laser light $LSR_{PLS}$ by a pseudo mirror is focused; the pseudo mirror is formed by the optical window member 14 when the distal-side end surface 142 of the optical window member 14 is fouled with contaminants DP (e.g., unburned fuel or soot) having deposited on the distal-side end surface 142. Furthermore, in the present embodiment, as shown in FIG. 2B, the catoptric-light focal point BFP falls in a region where no solid material forming either the focusing optical element 13 or the optical window member 14 exists.

Moreover, in terms of securing a sufficient pressure-resistant strength of the optical window member 14 so as to reliably protect the focusing optical element 13 from the combustion pressure in the combustion chamber 500, it is preferable to set the thickness $T_{CG}$ (shown in FIG. 2A) of the optical window member 14 as large as possible. On the other hand, with increase in the thickness $T_{CG}$ of the optical window member 14, it becomes easier for the catoptric-light focal point BFP to be formed within the focusing optical element 13 or the optical window member 14; thus, it becomes necessary to increase the focal length $L_{FP}$ of the focusing optical element 13 so as to prevent formation of the catoptric-light focal point BFP within the focusing optical element 13 or the optical window member 14. However, with increase in the focal length $L_{FP}$ of the focusing optical element 13, the power density of the pulsed laser light $LSR_{PLS}$ at the focal point FP decreases, thereby making it difficult to reliably ignite the air-fuel mixture in the combustion chamber 500. Therefore, in terms of securing a sufficient ignition capability of the laser ignition apparatus 1, it is preferable to set the thickness $T_{CG}$ of the optical window member 14 as small as possible.

The inventors of the present invention have found, through an experimental investigation, that when the optical window member 14 is made of a sapphire glass, it is possible to secure a withstand pressure of 40 MPa for the optical window member 14 with the thickness $T_{CG}$ of the optical window member 14 set to 2.5 mm.

The housing 15 is substantially tubular in shape and made of a heat-resistant metal material such as stainless steel. The housing 15 has the regulating optical element 10, the laser resonator 11, the enlarging optical element 12, the focusing optical element 13 and the optical window member 14 retained therein so that all the elements 10-14 are coaxial with each other.

Further, between the elements 10-14 and the housing 15, there are suitably interposed metal-made elastic members to absorb dimensional differences therebetween, thereby making the optical axes of the elements 10-14 coincident with each other and setting the focal lengths of the elements 10-14 to respective predetermined values.

Furthermore, referring to FIGS. 1 and 2A-2B, in the present embodiment, the distances between the enlarging optical element 12, the focusing optical element 13 and the optical window member 14, the position of the focal point FP, the thickness $T_{FL}$ of the focusing optical element 13 and the thickness $T_{CG}$ of the optical window member 14 are set so that: the power density of the pulsed laser light $LSR_{PLS}$ is lower than or equal to a damage threshold power density $FI_{BRK}$ of the focusing optical element 13 when the pulsed laser light $LSR_{PLS}$ passes through the focusing optical element 13; the power density of the pulsed laser light $LSR_{PLS}$ is lower than or equal to a damage threshold power density $FI_{BRK}$ of the optical window member 14 when the pulsed laser light $LSR_{PLS}$ passes through the optical window member 14; and the power density $FI_{SRF}$ of the pulsed laser light $LSR_{PLS}$ at the distal-side end surface 142 of the optical window member 14 is higher than or equal to a burn-off threshold power density $FI_{DEP}$. Here, the damage threshold power density $FI_{BRK}$ of the focusing optical element 13 is defined such that the focusing optical element 13 can be damaged if the power density of the pulsed laser light $LSR_{PLS}$ is higher than it when the pulsed laser light $LSR_{PLS}$ passes through the focusing optical element 13. The damage threshold power density $FI_{BRK}$ of the optical window member 14 is defined such that the optical window member 14 can be damaged if the power density of the pulsed laser light $LSR_{PLS}$ is higher than it when the pulsed laser light $LSR_{PLS}$ passes through the optical window member 14. The burn-off threshold power density $FI_{DEP}$ is defined such that the contaminants DP having deposited on or adhered to the distal-side end surface 142 of the optical window member 14 can be burned off if the power density $FI_{SRF}$ of the pulsed laser light $LSR_{PLS}$ at the distal-side end surface 142 is higher than or equal to the burn-off threshold power density $FI_{DEP}$.

In addition, from the results of experiments to be described later, it has been made clear that: the burn-off threshold power density $FI_{DEP}$ is equal to 400 MW/cm$^2$; and the damage threshold power densities $FI_{BRK}$ of the focusing optical element 13 and the optical window member 14 are equal to 40.5 GW/cm$^2$ when they are made of a quartz glass and to 45.2 GW/cm$^2$ when they are made of a sapphire glass. In other words, it has been made clear that by setting the power density $FI_{SRF}$ of the pulsed laser light $LSR_{PLS}$ at the distal-side end surface 142 of the optical window member 14 to be higher than 400 MW/cm$^2$, it is possible to burn off the contaminants DP having deposited on or adhered to the distal-side end surface 142, thereby maintaining stable ignition of the air-fuel mixture in the combustion chamber 500. It also has been made clear that in the case of the focusing optical element 13 and the optical window member 14 being made of a highly-durable optical element material, such as a quartz glass or a sapphire glass, they can be prevented from being damaged by setting the power density of the pulsed laser light $LSR_{PLS}$ to be not higher than 40.5 GW/cm$^2$ when the pulsed laser light $LSR_{PLS}$ passes through them.

Moreover, in the present embodiment, the following dimensional relationships are satisfied: $L_{FP}=L_{SF}+T_{CG}+G$; and $L_{FP}+T_{FL}<2L_{SF}$, where $L_{FP}$ is the distance from the distal-side end surface (i.e., the light exit surface) 132 of the focusing optical element 13 to the focal point FP, $L_{SF}$ is the distance from the distal-side end surface the light exit surface) 142 of the optical window member 14 to the focal point FP, $T_{CG}$ is the thickness of the optical window member 14, G is the distance (or axial gap) between the distal-side end surface 132 of the focusing optical element 13 and the proximal-side end surface (i.e., the light entrance surface) 141 of the optical window member 14, and $T_{FL}$ is the thickness of the focusing optical element 13.

Referring to FIG. 2A, in a normal operating state of the laser ignition apparatus 1, the pulsed laser light $LSR_{PLS}$ is focused by the focusing optical element 13 at the focal point FP, thereby forming a high-energy-state plasma flame kernel to ignite the air-fuel mixture in the combustion chamber 500; the focal point 13 is positioned away from the distal-side end surface 132 of the focusing optical element 13 by the distance $L_{FP}$.

Moreover, in the normal operating state, the power density of the pulsed laser light $LSR_{PLS}$ at the distal-side end surface 142 of the optical window member 14 is higher than or equal to the burn-off threshold power density $FI_{DEP}$. Consequently, even if there are some contaminants DP having adhered to the distal-side end surface 142 of the optical window member 14, the contaminants DP will be burnt off by absorbing the energy of the pulsed laser light $LSR_{PLS}$ without further accumulating on the distal-side end surface 142. As a result, it is possible to maintain stable ignition of the air-fuel mixture in the combustion chamber 500.

On the other hand, referring to FIG. 2B, in an abnormal operating state of the laser ignition apparatus 1, the optical window member 14 is fouled with contaminants DP deposited on the distal-side end surface 142 thereof, forming a pseudo mirror. Consequently, the pulsed laser light $LSR_{PLS}$ outputted from the focusing optical element 13 is reflected by the pseudo mirror, resulting in the catoptric light $BLSR_{PLS}$ which is focused at the catoptric-light focal point BFP. The catoptric-light focal point BFP is positioned on the proximal side of the reference surface 142 (i.e., the distal-side end surface 142 of the optical window member 14) so that the focal point FP and the catoptric-light focal point BFP are substantially symmetrical with respect to the reference surface 142.

Further, in the present embodiment, the catoptric-light focal point BFP is positioned in a region where no solid material forming either the focusing optical element 13 or the optical window member 14 exists. Moreover, the catoptric-light focal point BFP is separated from the combustion chamber 500 by, at least, the optical window member 14; therefore, there is no burnable substance in the vicinity of the catoptric-light focal point BFP. Consequently, no plasma will be generated by the catoptric light $BLSR_{PLS}$ and thus no damage will be made to the focusing optical element 13 and the optical window member 14 due to the catoptric light $BLSR_{PLS}$.

In addition, when the catoptric-light focal point BFP is positioned very close to the focusing optical element 13 and the power density of the catoptric light $BLSR_{PLS}$ in the vicinity of the catoptric-light focal point BFP exceeds the damage threshold power density $FI_{BRK}$ of the focusing optical element 13 (i.e. 40.5 GW/cm$^2$), the focusing optical element 13 may be damaged by the catoptric light $BLSR_{PLS}$. Therefore, it is necessary to suitably arrange the focusing optical element 13 and the optical window member 14 so as to make the distance $L_{SB}$ from the reference surface 142 to the catoptric-light focal point BFP sufficiently long, thereby making the power density of the catoptric light $BLSR_{PLS}$ not higher than 40.5 GW/cm$^2$ in the focusing optical element 13.

Next, a first experiment, which was conducted by the inventors of the present invention for determining the damage threshold power densities $FI_{BRK}$ of the focusing optical element 13 and the optical window member 14, will be described with reference to FIGS. 3A-3C and 4A-4B.

Figure 3A:
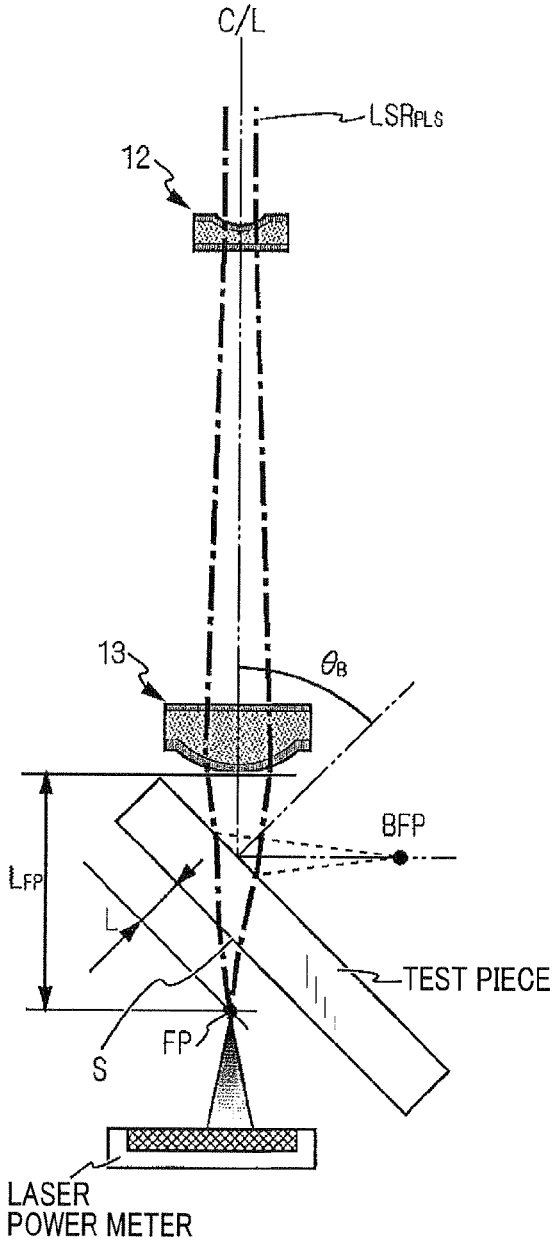
FIGS. 3A-3C are schematic views illustrating the manner in which a first experiment was conducted by the inventors of the present invention.

In the first experiment, as shown in FIG. 3A, a test piece of an optical element material for forming the focusing optical element 13 or the optical window member 14 was first set in an experimental setup so as to make Brewster's angle $\theta_B$ between the light entrance surface (i.e., the proximal-side end surface) of the test piece and the optical axis C/L of the experimental setup. The experimental setup included the enlarging optical element 12, the focusing optical element 13 and a laser power meter. Brewster's angle $\theta_B$ was determined by the following equation: $\theta_B=\arctan(n_2/n_1)$, where $n_1$ is the refractive index of the initial medium (i.e., air) and $n_2$ is the refractive index of the other medium (i.e., the test piece). Consequently, the determined Brewster's angle $\theta_B$ was approximately equal to 56° with $n_1$ and $n_2$ being respectively equal to 1 and 1.5.

In addition, by inclining the test piece to make Brewster's angle $\theta_B$ with respect to the optical axis C/L, it become possible to locate the catoptric-light focal point BFP outside the focusing optical element 13 in a direction perpendicular to the optical axis C/L, thereby preventing the focusing optical element 13 from being damaged during the first experiment.

Figure 3B:
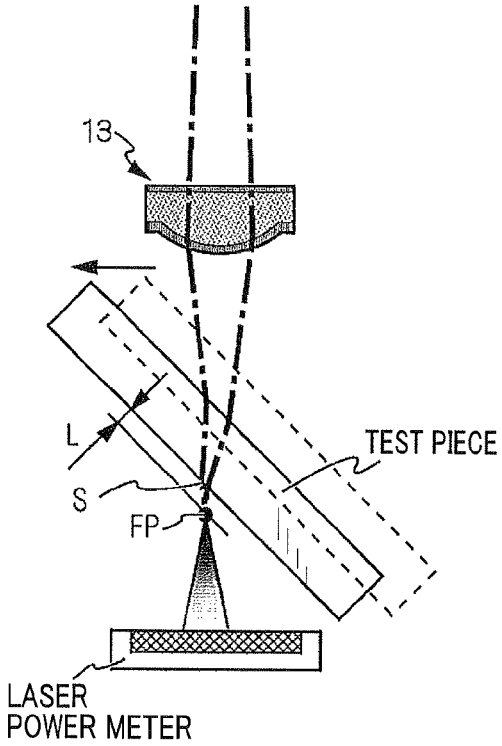

As shown in FIG. 3B, the test piece was then gradually translated in the direction perpendicular to the optical axis C/L, thereby gradually varying both the focusing area S on the distal-side end surface of the test piece and the distance L from the distal-side end surface of the test piece to the focal point FP. At the same time, the power of the pulsed laser light $LSR_{PLS}$ at the focal point FP was measured using the laser power meter. Further, the power density FI of the pulsed laser light $LSR_{PLS}$ at the distal-side end surface of the test piece was computed based on the focusing area 5, the distance L and the measured power of the pulsed laser light $LSR_{PLS}$ at the focal point FP.

Figure 3C:
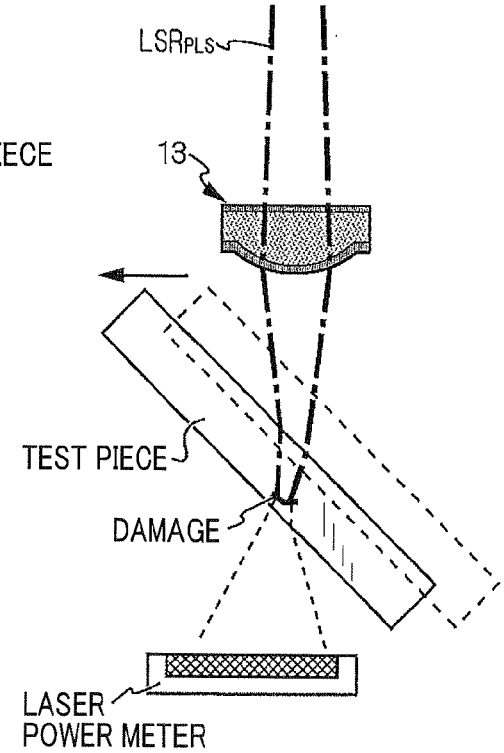

Moreover, as shown in FIG. 3C, during the first experiment, when the power density FI of the pulsed laser light $LSR_{PLS}$ in the test piece was too high, damage was caused to the test piece, more particularly, cracks occurred in the test piece. Consequently, the pulsed laser light $LSR_{PLS}$ passing through the test piece was scattered, thereby lowering the output of the laser power meter. Therefore, it was possible to determine the damage threshold power density $FI_{BRK}$ of the test piece by determining the highest power density FI which did not cause the output of the laser power meter to be lowered.

Figure 4A:
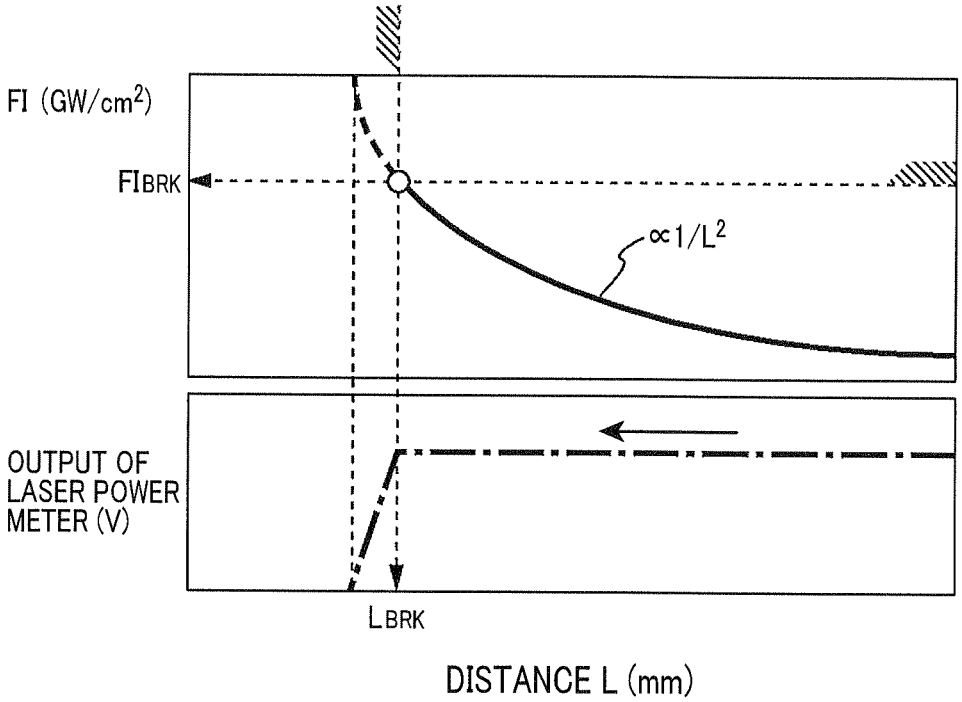
FIG. 4A is a graphical representation showing results of the first experiment.
Figure 4B:
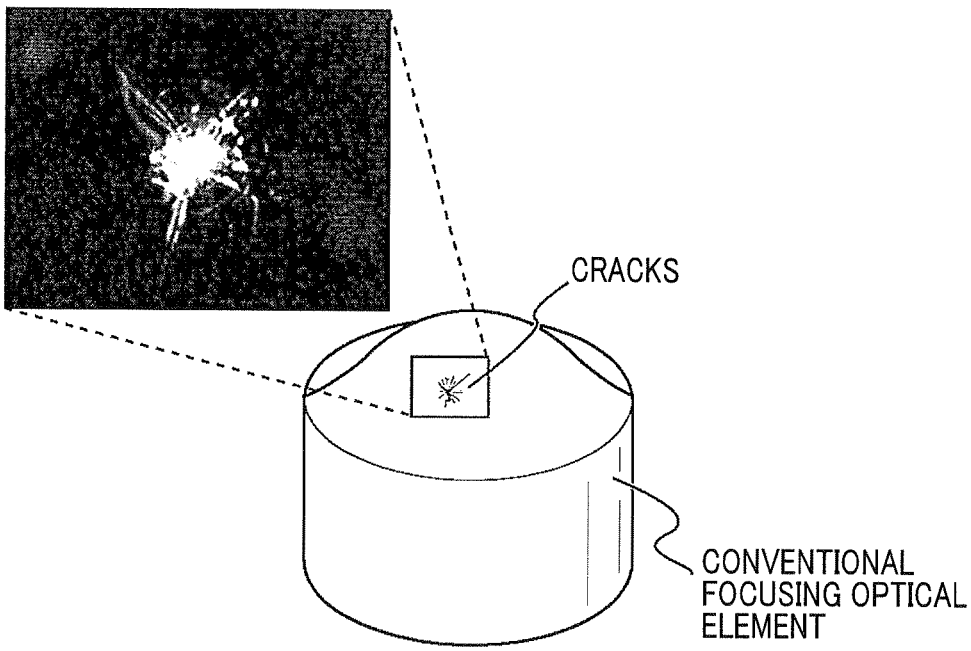
FIG. 4B is a schematic view illustrating occurrence of cracks in a focusing optical element of a conventional laser ignition apparatus.

FIG. 4A shows the experimental results for the test piece. On the other hand, FIG. 4B illustrates occurrence of cracks in a focusing optical element of a conventional laser ignition apparatus.

As shown in FIG. 4A, with decrease in the distance L, the focusing area S also decreased; accordingly the power density FI at the distal-side end surface of the test piece increased in inverse proportion to the square of the distance L. Moreover, when the distance L was decreased below a threshold value, namely the damage threshold distance $L_{BRK}$, damage was made to the test piece, thereby lowering the output (in voltage) of the laser power meter. The power density FI at the damage threshold distance $L_{BRK}$ was determined as the damage threshold power density $FI_{BRK}$ of the test piece.

In the first experiment, a plurality of test pieces of different optical element materials were tested in the same manner as described above; those optical element materials included a heat-resistant optical glass (more specifically, a heat-resistant borosilicate glass), an ordinary optical glass (more specifically, a borosilicate glass), a quartz glass and a sapphire glass. In addition, the test condition was as follows: applied energy=3.16 mJ; pulse width=0.78 ns; output=4.05 MW; drive frequency=30 Hz; and beam diameter=1.2 mm.

The test results of all the test pieces are summarized in TABLE 1.

TABLE 1

| Damage Threshold Values | Heat-Resistant Optical Glass ($SiO_2 \cdot B_2O_3$) | Ordinary Optical Glass ($SiO_2 \cdot B_2O_3$) | Quartz Glass ($SiO_2$) | Sapphire Glass ($Al_2O_3$) |
|---|---|---|---|---|
| Beam Center Intensity $I_{CNT}$ (GW/cm$^2$) | 23.2 | 28.7 | 40.5 | 45.2 |
| Beam Average Intensity $I_{AVE}$ (GW/cm$^2$) | 5.41 | 12.3 | 8.03 | 13.5 |
| Distance L (mm) | 0.7 | 0.6 | 0.35 | 0.3 |

From TABLE 1, it has been made clear that if the quartz glass is used as the material of the focusing optical element 13 and the optical window member 14, they may be damaged with the power density of the pulsed laser light $LSR_{PLS}$ being higher than 40.5 GW/cm$^2$. It is also made clear that if the sapphire glass is used as the material of the focusing optical element 13 and the optical window member 14, they may be damaged with the power density of the pulsed laser light $LSR_{PLS}$ being higher than 45.2 GW/cm$^2$. In addition, quartz glasses are widely used as optical element materials in laser apparatuses that output laser lights with relatively high power densities. On the other hand, sapphire glasses are some of the most durable among optical element materials for use in laser apparatuses.

Moreover, as seen from TABLE 1, the test pieces of the different optical element materials had the different damage threshold values. Therefore, in practice, it is necessary to design the structural parameters of the enlarging optical element 12, the focusing optical element 13 and the optical window member 14 according to the materials of the focusing optical element 13 and the optical window member 14, so as to ensure that the power densities $FI_{SRF}$ and $FI_{BCK}$ of the pulsed laser light $LSR_{PLS}$ and the catoptric light $BLSR_{PLS}$ are not higher than the damage threshold power densities $FI_{BRK}$ of those materials when the lights $LSR_{PLS}$ and $BLSR_{PLS}$ pass through the focusing optical element 13 and the optical window member 14. In addition, the structural parameters of the enlarging optical element 12, the focusing optical element 13 and the optical window member 14 include the thicknesses thereof, the refractive indexes thereof, the curvatures thereof and the distances therebetween.

Next, a second experiment, which was conducted by the inventors of the present invention for determining the burn-off threshold power density $FI_{DEP}$, will be described with reference to FIGS. 5A-5C, 6A-6C and 7A-7B.

In the second experiment, contaminant samples $Q_{DEP}$ were employed to simulate the contaminants DP having adhered to the distal-side end surface 142 of the optical window member 14. As shown in FIG. 5C, each contaminant sample $Q_{DEP}$ was made by: (1) printing a paste whose main component was carbon on a transparent film; and (2) drying the paste together with the film.

Moreover, in the second experiment, the pulsed laser light $LSR_{PLS}$ was irradiated to the optical window member 14 in different combinations of two test conditions, two input conditions A and B of the pulsed laser light $LSR_{PLS}$ and three focusing optical systems a, b and c.

Figure 5A:
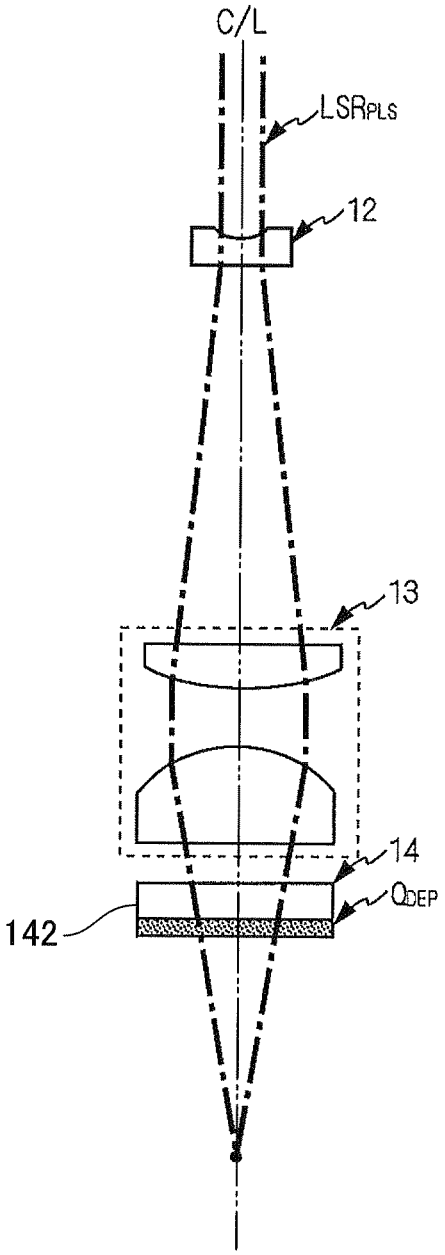
FIG. 5A is a schematic view illustrating a first test condition used in a second experiment conducted by the inventors of the present invention.
Figure 5B:
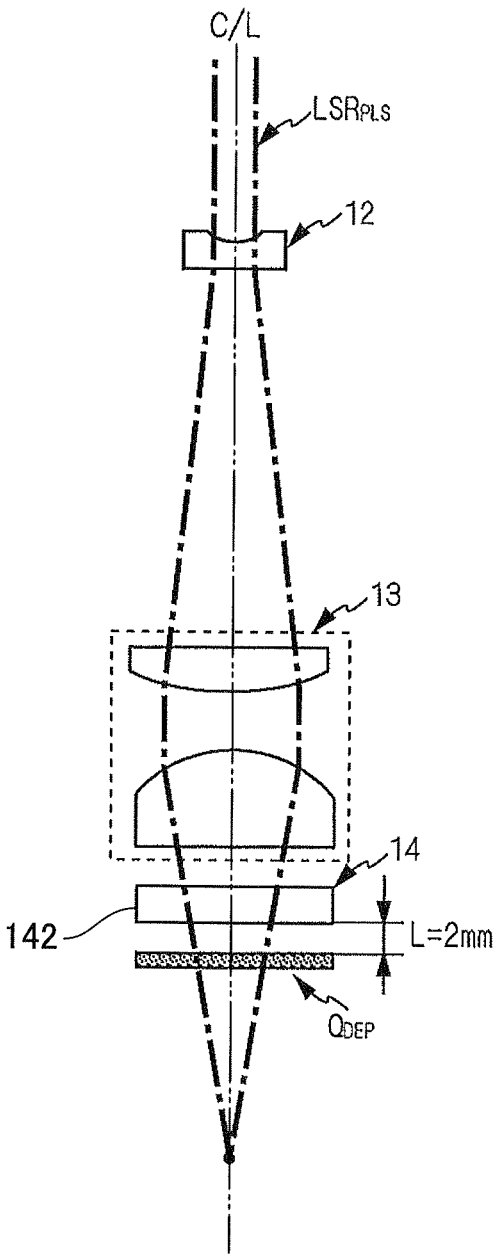
FIG. 5B is a schematic view illustrating a second test condition used in the second experiment.
Figure 5C:
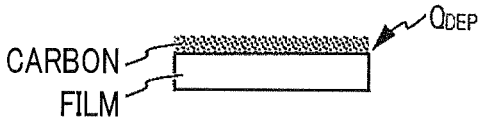
FIG. 5C is a schematic view showing a contaminant sample used in the second experiment.

In the first test condition, as shown in FIG. 5A, the contaminant sample $Q_{DEP}$ was arranged in intimate contact with the distal-side end surface 142 of the optical window member 14. In the second test condition, as shown in FIG. 5B, the contaminant sample $Q_{DEP}$ was arranged away from the distal-side end surface 142 of the optical window member 14 by a distance L of 2 mm.

The input condition A of the pulsed laser light $LSR_{PLS}$ was as follows: applied energy=5.2 mJ; and pulse width=1.6 ns. The input condition B of the pulsed laser light $LSR_{PLS}$ was as follows: applied energy=11.5 mJ; and pulse width=0.87 ns.

Figure 6A:
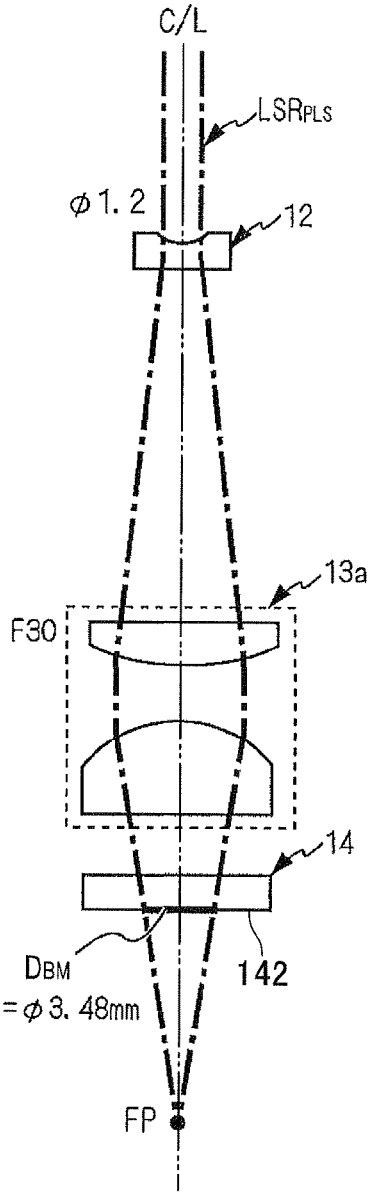
FIGS. 6A-6C are schematic views respectively illustrating three focusing optical systems a-c used in the second experiment.
Figure 6B:
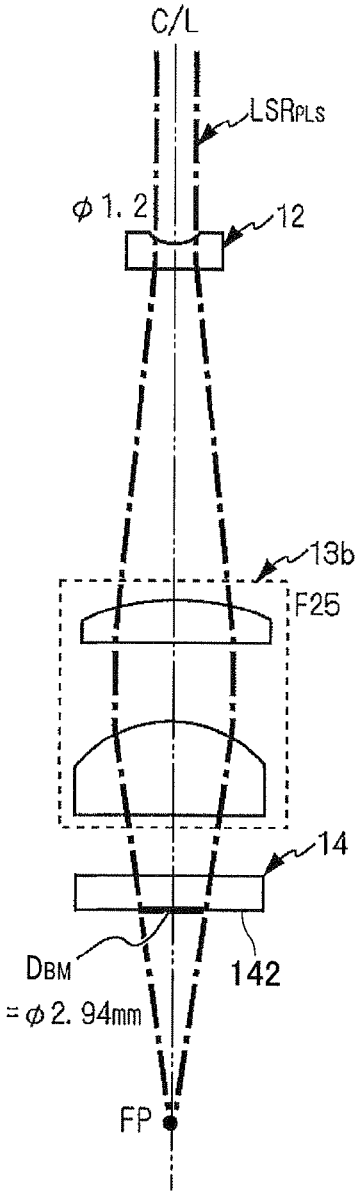

In the focusing optical system a, as shown in FIG. 6A, the beam diameter $D_{BM}$ of the pulsed laser light $LSR_{PLS}$ at the distal-side end surface 142 of the optical window member 14 was equal to 3.48 mm. In the focusing optical system b, as shown in FIG. 6B, the beam diameter $D_{BM}$ of the pulsed laser light $LSR_{PLS}$ at the distal-side end surface 142 of the optical window member 14 was equal to 2.94 mm. In the focusing optical system c, as shown in FIG. 6C, the beam diameter $D_{BM}$ of the pulsed laser light $LSR_{PLS}$ at the distal-side end surface 142 of the optical window member 14 was equal to 2.49 mm.

Figure 6C:
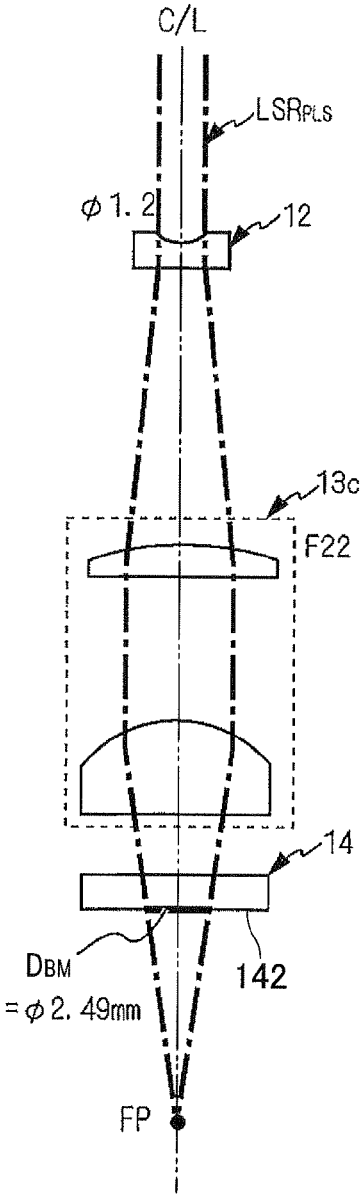

In addition, F30, F25 and F22 shown in FIGS. 6A-6C respectively represent the f-numbers of the focusing optical systems a, b and c. The smaller the f-numbers, the higher the power density of the pulsed laser light $LSR_{PLS}$ was at the distal-side end surface 142 of the optical window member 14.

Figure 7A:
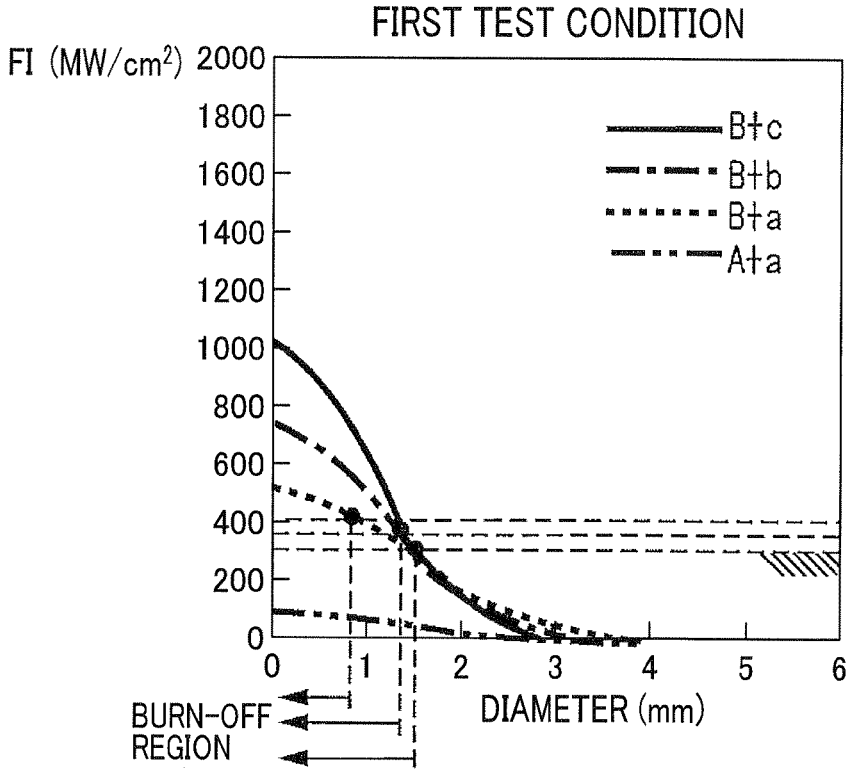
FIG. 7A is a graphical representation illustrating the change in the power density of the pulsed laser light with diameter for those tests which were conducted in the first test condition in combinations with the three focusing optical systems a-c.
Figure 7B:
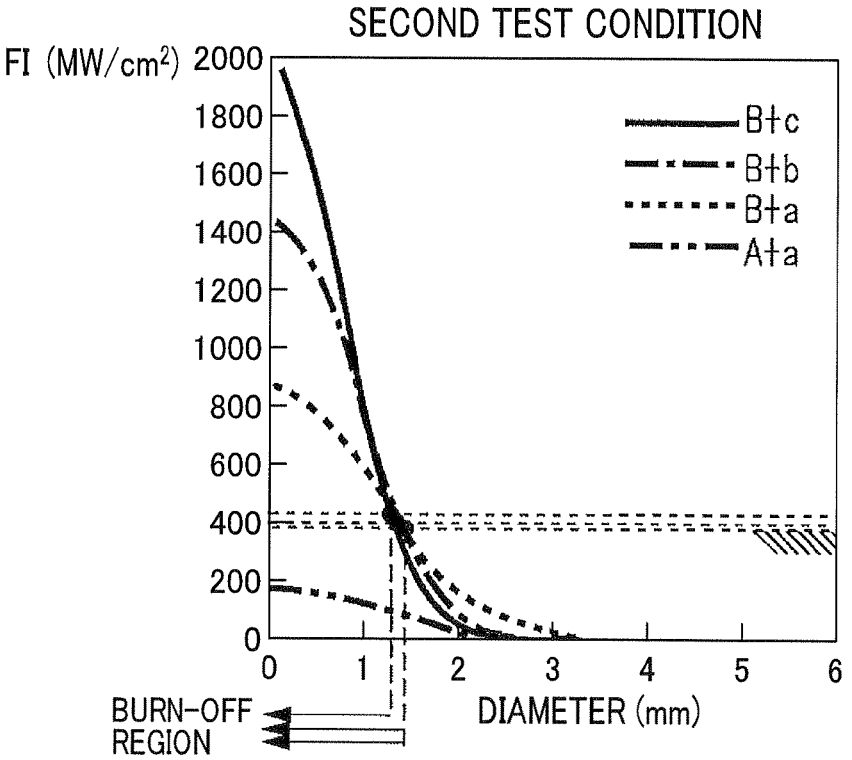
FIG. 7B is a graphical representation illustrating the change in the power density of the pulsed laser light with diameter for those tests which were conducted in the second test condition in combinations with the three focusing optical systems a-c.
Figure 9:
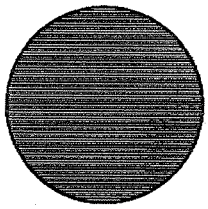
FIG. 9 shows "Table 2, which illustrates the effect of burning off carbon in a contaminant sample under different test conditions.
Figure 9:
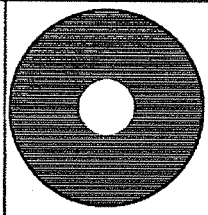
Figure 9:
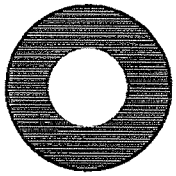
Figure 9:
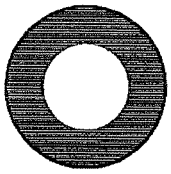
Figure 9:
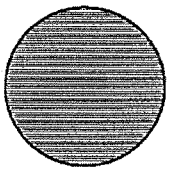
Figure 9:
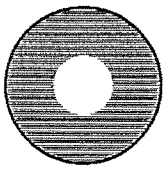
Figure 9:
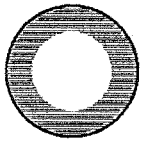
Figure 9:
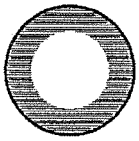

The results of the second experiment are shown in TABLE 2 (as shown in FIG. 9) and FIGS. 7A-7B.

TABLE 2 illustrates the effect of burning-off the carbon included in the contaminant sample $Q_{DEP}$ in each of tests which were conducted in different combinations of the first and second test conditions, the input conditions A and B of the pulsed laser light $LSR_{PLS}$ and the focusing optical systems a-c. More specifically, in TABLE 2, the black areas in the circular or annular figures represent those areas where the carbon remains in the contaminant sample $Q_{DEP}$, while the white areas within the respective black areas represent those areas where the carbon was burned off by the pulsed laser light $LSR_{PLS}$. In addition, the numbers shown immediately below the respective figures represent the diameters of the white areas (i.e., the areas where the carbon was burned off).

As seen from TABLE 2 (shown in FIG. 9), when the input condition A of the pulsed laser light $LSR_{PLS}$ was used in combination with either of the first and second test conditions, the power density of the pulsed laser light $LSR_{PLS}$ at the contaminant sample $Q_{DEP}$ was too low to burn off the carbon included in the contaminant sample $Q_{DEP}$.

In comparison, when the input condition B of the pulsed laser light $LSR_{PLS}$ was used in combination with either of the first and second test conditions, the power density of the pulsed laser light $LSR_{PLS}$ at a central portion of the contaminant sample $Q_{DEP}$ was high enough to burn off the carbon included in the central portion.

FIG. 7A shows the change in the power density FI of the pulsed laser light $LSR_{PLS}$ with diameter for those tests each of which was conducted in the first test condition in combination with one of the focusing optical systems a, b and c. In addition, in FIG. 7A, for each of the tests, the burn-off region in which it was possible to burn off the carbon included in the contaminant sample $Q_{DEP}$ is also indicated.

FIG. 7B shows the change in the power density FI of the pulsed laser light $LSR_{PLS}$ with diameter for those tests each of which was conducted in the second test condition in combination with one of the focusing optical systems a, b and c. In addition, in FIG. 7B, for each of the tests, the burn-off region in which it was possible to burn off the carbon included in the contaminant sample $Q_{DEP}$ is also indicated.

As seen from FIGS. 7A and 7B, in each of the tests, it was possible to burn off the carbon included in the contaminant sample $Q_{DEP}$ with the power density FI of the pulsed laser light $LSR_{PLS}$ being higher than or equal to 400 $MW/cm^2$.

Accordingly, it has been made clear, from the above results of the second experiment, that when the distal-side end surface 142 of the optical window member 14 is fouled with contaminants DP having deposited on or adhered to the distal-side end surface 142, it is possible to burn off the contaminants DP with the power density FI of the pulsed laser light $LSR_{PLS}$ at the distal-side end surface 142 being higher than or equal to 400 $MW/cm^2$, namely the burn-off threshold power density $FI_{DEP}$. Further, by burning-off the contaminants DP, it is possible to keep the distal-side end surface 142 of the optical window member 14 clean, thereby preventing a pseudo mirror from being formed by the optical window member 14 due to the contaminants DP. Consequently, it is possible to prevent the pulsed laser light $LSR_{PLS}$ from being reflected by a pseudo mirror to form a catoptric light, thereby preventing the focusing optical element 13 and the optical window member 14 from being damaged by the focusing of a catoptric light therein. In addition, with the distal-side end surface 142 of the optical window member 14 kept clean, it is possible to secure a high power density of the pulsed laser light $LSR_{PLS}$ at the focal point FP.

Next, the relationship between the position of the catoptric-light focal point BFP and the axial gap G (see FIGS. 2A-2B) between the focusing optical element 13 and the optical window member 14 will be described with reference to FIGS. 8A-8E.

It should be noted that the output condition of the pulsed laser light $LSR_{PLS}$, the focal length $L_{FP}$, the thickness $T_{FL}$ of the focusing optical element 13 and the thickness $T_{CG}$ of the optical window member 14 are the same for all the five different arrangements of the laser ignition apparatus 1 shown in FIGS. 8A-8E. It also should be noted that: subscript numbers 1-5 are added to the axial gap G in FIGS. 8A-8E only for the purpose of differentiating the five different arrangements shown in those figures; and all the dimensional parameters L1-L5 shown in FIGS. 8A-8E correspond to the same dimensional parameter $L_{SF}$ shown in FIGS. 2A and 2B which represents the distance from the distal-side end surface 142 of the optical window member 14 to the focal point FP. In addition, as shown in FIGS. 2A and 2B, the distance $L_{SF}$ is approximately equal to the distance $L_{SB}$ from the distal-side end surface 142 of the optical window member 14 to the catoptric-light focal point BFP.

Figure 8A:
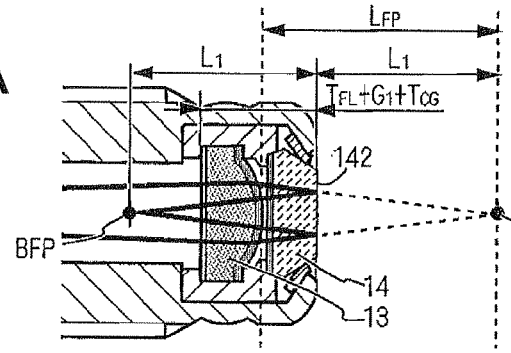
FIGS. 8A-8E are schematic views illustrating the relationship between the position of a catoptric-light focal point formed in the laser ignition apparatus and the axial gap G between the optical window member and a focusing optical element of the laser ignition apparatus.

First, as shown in FIG. 8A, when $0<G<\{L_{FP}-(T_{FL}+2T_{CG})\}/2$, in other words, when the axial gap G is sufficiently small but greater than zero, the catoptric-light focal point BFP is positioned on the proximal side of the focusing optical element 13. Consequently, it is possible to prevent both the focusing optical element 13 and the optical window member 14 from being damaged by the catoptric light $BLSR_{PLS}$. That is, both the focusing optical element 13 and the optical window member 14 can be prevented from being damaged only if the power density FI of the pulsed laser light $LSR_{PLS}$ is kept lower than 40.5 $GW/cm^2$ within those elements 13 and 14.

In addition, when G=0, in other words, when the focusing optical element 13 and the optical window member 14 are arranged in intimate contact with each other, heat generated in the combustion chamber 500 will be conducted to the focusing optical element 13 via the optical window member 14, thereby causing problems such as a deviation of the position of the focal point FP and decrease in the durability of the focusing optical element 13.

Figure 8B:
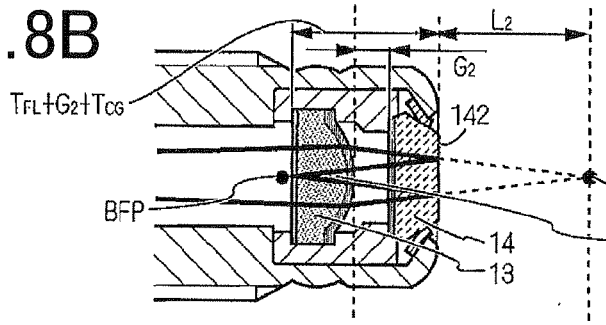
Figure 8C:
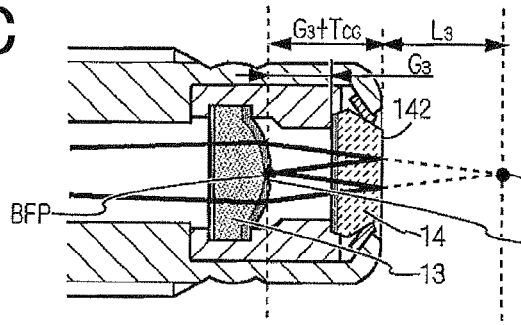

Secondly, as shown in FIGS. 8B and 8C, when $\{L_{FP}-(T_{FL}+2T_{CG})\}/2\leq G\leq(L_{FP}-2T_{CG})/2$, the catoptric-light focal point BFP is positioned within the focusing optical element 13. Consequently, the focusing optical element 13 can be damaged by the catoptric light $BLSR_{PLS}$ if the power density $FI_{BCK}$ of the catoptric light $BLSR_{PLS}$ at the catoptric-light focal point BFP is higher than 40.5 $GW/cm^2$.

Figure 8D:
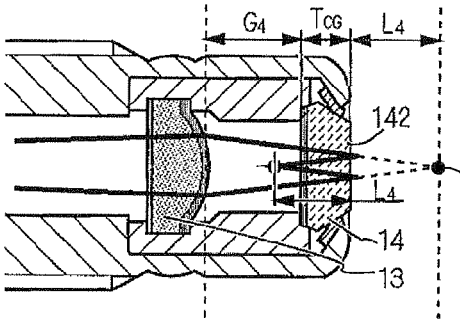

Thirdly, as shown in FIG. 8D, when $(L_{FP}-2T_{CG})/2<G<(L_{FP}-2T_{CG})$, the catoptric-light focal point BFP is positioned between the focusing optical element 13 and the optical window member 14. Consequently, it is possible to prevent both the focusing optical element 13 and the optical window member 14 from being damaged by the catoptric light $BLSR_{PLS}$. That is, both the focusing optical element 13 and the optical window member 14 can be prevented from being damaged only if the power density FI of the pulsed laser light $LSR_{PLS}$ is kept lower than 40.5 $GW/cm^2$ within those elements 13 and 14.

Figure 8E:
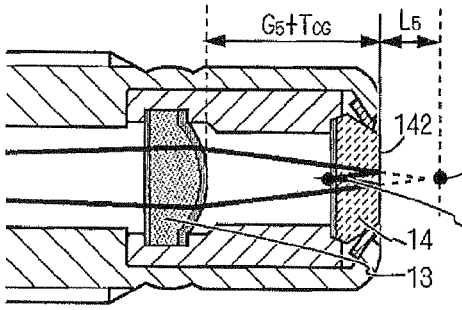

Finally, as shown in FIG. 8E, when $(L_{FP}-2T_{CG})\leq G$, the catoptric-light focal point BFP is positioned within the optical window member 14. Consequently, the optical window member 14 can be damaged by the catoptric light $BLSR_{PLS}$ if the power density $FI_{BCK}$ of the catoptric light $BLSR_{PLS}$ at the catoptric-light focal point BFP is higher than 40.5 $GW/cm^2$.

In view of the above, in the laser ignition apparatus 1, it is preferable that $L_{FP}+T_{FL}<2L_{SF}$, so as to position the catoptric-light focal point BFP on the proximal side of the focusing optical element 13. More specifically, in this case, referring to FIGS. 2A and 2B, by substituting $L_{FP}=L_{SF}+T_{CG}+G$ into the above inequality, it is possible to obtain $T_{CG}+G+T_{FL}<L_{SF}$. Further, $L_{SB}$ is approximately equal to $L_{SF}$, and accordingly $T_{CG}+G+T_{FL}<L_{SB}$. That is, the catoptric-light focal point BFP is positioned on the proximal side of the focusing optical element 13.

Alternatively, it is also preferable that $(L_{FP}-2T_{CG})/2<G<(L_{FP}-2T_{CG})$. In this case, as explained above, the catoptric-light focal point BFP is positioned between the focusing optical element 13 and the optical window member 14 (see FIG. 8D).

To sum up, the laser ignition apparatus 1 according to the present embodiment has the following advantages.

In the present embodiment, the laser ignition apparatus 1 includes: the excitation light source 2 configured to output the excitation light $LSR_{PMP}$; the regulating optical element 10 configured to regulate the excitation light $LSR_{PMP}$ and introduce the regulated excitation light $LSR_{PMP}$ into the laser resonator 11; the laser resonator 11 configured to generate, upon introduction of the regulated excitation light $LSR_{PMP}$ from the regulating optical element 10 thereinto, the pulsed laser light $LSR_{PLS}$ and output the generated pulsed laser light $LSR_{PLS}$; the enlarging optical element 12 configured to enlarge the beam diameter of the pulsed laser light $LSR_{PLS}$ outputted from the laser resonator 11 and output the beam diameter-enlarged pulsed laser light $LSR_{PLS}$; the focusing optical element 13 configured to focus the beam diameter-enlarged pulsed laser light $LSR_{PLS}$ outputted from the enlarging optical element 12 to the focal point FP in the combustion chamber 500 of the engine 5, thereby igniting the air-fuel mixture in the combustion chamber 500; and the optical window member 14 arranged on the distal side (i.e., the combustion chamber side) of the focusing optical element 13 so as to separate the focusing optical element 13 from the combustion chamber 500. The optical window member 14 has the distal-side end surface (i.e., the combustion chamber-side end surface) 142 that faces the combustion chamber 500 and is thus directly exposed to the air-fuel mixture in the combustion chamber 500. Moreover, the catoptric-light focal point BFP, at which the catoptric light $BLSR_{PLS}$ is to be focused, is positioned on the proximal side (i.e., the anti-combustion chamber side) of the distal-side end surface 142 of the optical window member 14. The catoptric light $BLSR_{PLS}$ results from the reflection of the pulsed laser light $LSR_{PLS}$ outputted from the focusing optical element 13 by the pseudo mirror that is formed by the optical window member 14 when the distal-side end surface 142 of the optical window member 14 is fouled with contaminants DP (e.g., unburned fuel or soot) existing in the combustion chamber 500. Further, the catoptric-light focal point BFP falls in a region where no solid material forming either the focusing optical element 13 or the optical window member 14 exists.

With the above configuration, there exists only air around the catoptric-light focal point BFP because the catoptric-light focal point BFP is positioned in a region where no solid material exists as well as because the catoptric-light focal point BFP is separated from the combustion chamber 500 by, at least, the optical window member 14. The density of air is far lower than that of a solid material. Consequently, even when the catoptric light $BLSR_{PLS}$ is focused at the catoptric-light focal point BFP, no plasma will be generated by the catoptric light $BLSR_{PLS}$ and thus no damage will be made to the focusing optical element 13 and the optical window member 14. As a result, it is possible to maintain stable ignition of the air-fuel mixture in the combustion chamber 500 of the engine 5 by the laser ignition apparatus 1.

Further, in the present embodiment, the laser ignition apparatus 1 is configured so that the power density $FI_{SRF}$ of the pulsed laser light $LSR_{PLS}$ at the distal-side end surface 142 of the optical window member 14 is higher than or equal to the burn-off threshold power density $FI_{DEP}$.

With the above configuration, when the distal-side end surface 142 of the optical window member 14 is fouled with the contaminants DP having deposited on or adhered to the distal-side end surface 142, it is possible to burn off the contaminants DP by the pulsed laser light $LSR_{PLS}$. Consequently, it is possible to keep the distal-side end surface 142 of the optical window member 14 clean, thereby preventing a pseudo mirror from being formed by the optical window member 14 due to the contaminants DP. Moreover, with the distal-side end surface 142 of the optical window member 14 kept clean, it is possible to secure a high power density of the pulsed laser light $LSR_{PLS}$ at the focal point FP, thereby reliably igniting the air-fuel mixture in the combustion chamber 500.

Furthermore, in the present embodiment, the laser ignition apparatus 1 is configured so that: the power density of the pulsed laser light $LSR_{PLS}$ or the catoptric light $BLSR_{PLS}$ is lower than or equal to the damage threshold power density $FI_{BRK}$ of the focusing optical element 13 when the pulsed laser light $LSR_{PLS}$ or the catoptric light $BLSR_{PLS}$ passes through the focusing optical element 13; and the power density of the pulsed laser light $LSR_{PLS}$ or the catoptric light $BLSR_{PLS}$ is lower than or equal to the damage threshold power density $FI_{BRK}$ of the optical window member 14 when the pulsed laser light $LSR_{PLS}$ or the catoptric light $BLSR_{PLS}$ passes through the optical window member 14.

With the above configuration, it is possible to prevent the focusing optical element 13 and the optical window member 14 from being damaged by the pulsed laser light $LSR_{PLS}$ or the catoptric light $BLSR_{PLS}$ passing through them. Consequently, it is possible to ensure high reliability of the laser ignition apparatus 1.

While the above particular embodiment has been shown and described, it will be understood by those skilled in the art that various modifications, changes, and improvements may be made without departing from the spirit of the invention.

What is claimed is:

1. A laser ignition apparatus comprising:

an excitation light source configured to output an excitation light;

a regulating optical element configured to regulate the excitation light outputted from the excitation light source;

a laser resonator configured to generate, upon introduction of the regulated excitation light from the regulating optical element thereinto, a pulsed laser light and output the generated pulsed laser light;

an enlarging optical element configured to enlarge the beam diameter of the pulsed laser light outputted from the laser resonator and output the beam diameter-enlarged pulsed laser light;

a focusing optical element configured to focus the beam diameter-enlarged pulsed laser light outputted from the enlarging optical element to a predetermined focal point in a combustion chamber of an engine, thereby igniting an air-fuel mixture in the combustion chamber; and an optical window member arranged on a combustion chamber side of the focusing optical element so as to separate the focusing optical element from the combustion chamber, the optical window member having a combustion chamber-side end surface that faces the combustion chamber and is thus directly exposed to the air-fuel mixture in the combustion chamber, wherein a catoptric-light focal point, at which a catoptric light is to be focused, is positioned on an anti-combustion chamber side of the combustion chamber-side end surface of the optical window member, the catoptric light resulting from reflection of the pulsed laser light outputted from the focusing optical element by a pseudo mirror that is formed by the optical window member when the combustion chamber-side end surface of the optical window member is fouled with contaminants existing in the combustion chamber, and the catoptric-light focal point falls in a region where no solid material forming either the focusing optical element or the optical window member exists.

2. The laser ignition apparatus as set forth in claim 1, wherein the following relationships are satisfied:

$$L_{FP}=L_{SF}+T_{CG}+G; \text{ and}$$

$$L_{FP}+T_{FL}<2L_{SF},$$

where $L_{FP}$ is a distance from a combustion chamber-side end surface of the focusing optical element to the focal point, $L_{SF}$ is a distance from the combustion chamber-side end surface of the optical window member to the focal point, $T_{CG}$ is a thickness of the optical window member, G is a distance between the combustion chamber-side end surface of the focusing optical element and an anti-combustion chamber-side end surface of the optical window member, and $T_{FL}$ is a thickness of the focusing optical element.

3. The laser ignition apparatus as set forth in claim 1, wherein the following inequality is satisfied:

$$(L_{FP}-2T_{CG})/2<G<(L_{FP}-2T_{CG}),$$

where $L_{FP}$ is a distance from a combustion chamber-side end surface of the focusing optical element to the focal point, $T_{CG}$ is a thickness of the optical window member, and G is a distance between the combustion chamber-side end surface of the focusing optical element and an anti-combustion chamber-side end surface of the optical window member.

4. The laser ignition apparatus as set forth in claim 1, wherein the laser ignition apparatus is configured so that a power density of the pulsed laser light at the combustion chamber-side end surface of the optical window member is higher than or equal to a burn-off threshold power density, the burn-off threshold power density being defined such that the contaminants having deposited on or adhered to the combustion chamber-side end surface of the optical window member can be burned off if the power density of the pulsed laser light at the combustion chamber-side end surface is higher than or equal to the burn-off threshold power density.

5. The laser ignition apparatus as set forth in claim 4, wherein the burn-off threshold power density is equal to 400 $MW/cm^2$.

6. The laser ignition apparatus as set forth in claim 1, wherein the laser ignition apparatus is configured so that a power density of the pulsed laser light or the catoptric light when the pulsed laser light or the catoptric light passes through the focusing optical element is lower than or equal to a damage threshold power density of the focusing optical element, the damage threshold power density being defined such that the focusing optical element can be damaged if the power density of the pulsed laser light or the catoptric light is higher than it when the pulsed laser light or the catoptric light passes through the focusing optical element.

7. The laser ignition apparatus as set forth in claim 6, wherein the focusing optical element is made of a quartz glass or a sapphire glass, and the damage threshold power density of the focusing optical element is equal to 40.5 $GW/cm^2$.

8. The laser ignition apparatus as set forth in claim 1, wherein the laser ignition apparatus is configured so that a power density of the pulsed laser light or the catoptric light when the pulsed laser light or the catoptric light passes through the optical window member is lower than or equal to a damage threshold power density of the optical window member, the damage threshold power density being defined such that the optical window member can be damaged if the power density of the pulsed laser light or the catoptric light is higher than it when the pulsed laser light or the catoptric light passes through the optical window member.

9. The laser ignition apparatus as set forth in claim 8, wherein the optical window member is made of a quartz glass or a sapphire glass, and the damage threshold power density of the optical window member is equal to 40.5 $GW/cm^2$.

* * * * *